United States Patent [19]

Horn

[11] Patent Number: 4,834,770

[45] Date of Patent: May 30, 1989

[54] PROCESS FOR THE SIMULTANEOUS CAUSTIC TREATMENT AND DYEING OF COTTON GOODS

[75] Inventor: Peter J. Horn, Basle, Switzerland

[73] Assignee: Ciba-Geigy Corporation, Ardsley, N.Y.

[21] Appl. No.: 65,802

[22] Filed: Jun. 24, 1987

[30] Foreign Application Priority Data

Jul. 30, 1986 [CH] Switzerland ..... 3062/86
Jan. 12, 1987 [CH] Switzerland ..... 80/87

[51] Int. Cl.[4] ..... D06P 1/30; D06P 1/22; D06M 1/10; D06M 1/22

[52] U.S. Cl. ..... 8/495; 8/537; 8/493; 8/650

[58] Field of Search ..... 8/493, 495, 537

[56] References Cited

U.S. PATENT DOCUMENTS 4,487,608 0/1984 Sloan ..... 8/493

FOREIGN PATENT DOCUMENTS 0013220 of 1980 European Pat. Off. .
3221096 of 1983 European Pat. Off. .
1948995 4/1971 Fed. Rep. of Germany .
8300172 of 1983 World Int. Prop. O. .

OTHER PUBLICATIONS

Derwent Abstract, DT-948995-Q (1969).
Chemical Abstract 75-37801m.

*Primary Examiner*—Prince E. Willis
*Assistant Examiner*—John F. McNally
*Attorney, Agent, or Firm*—Edward McC. Roberts; Meredith C. Findlay

[57] ABSTRACT

A process for the simultaneous caustic treatment and dyeing of cotton goods with vat dyes by the pad steam process, wherein the goods, after being padded with a dye liquor and dried, are subjected to a caustic treatment step and subsequently further treated in conventional manner.

6 Claims, No Drawings

PROCESS FOR THE SIMULTANEOUS CAUSTIC TREATMENT AND DYEING OF COTTON GOODS

The present invention relates to a novel process for the simultaneous caustic treatment and dyeing of cotton goods.

In practice, cotton goods are very often mercerised, or treated with alkali liquor, before or after dyeing, the treatment being effected with a concentrated alkali liquor. This caustic treatment is carried out for various reasons: for example the handle and lustre of the fabric are improved and dyeability is enhanced. A further important aspect of caustic treatment is the enhancement of the dyeability of dead and immature cotton.

It is common practice always to carry out the caustic treatment separately from the dyeing procedure, i.e. in a special step. In spite of all precautionary measures, difficulties may still arise. Thus, for example, dyeing premercerised, closely woven fabrics with vat dyes by the pad-steam process results in an unlevel, sooty appearance of the goods. If, for example, cotton fabric which has been dyed with vat dyes is mercerised, then the change of shade must be taken into account when effecting the subsequent caustic treatment and neutralisation. As the conditions of this treatment cannot always be observed exactly, it is difficult to avoid variations in shade from batch to batch.

It is also known to carry out the caustic treatment of the cotton goods with an intermediate drying of the goods between the caustic treatment and the last washing and drying. In this case the fibres may be damaged if the alkali has a conventional strength of 267–345 g/l of solid sodium hydroxide (28°–33° Baumé). The proposal was therefore made to effect treatment with alkali having a strength of only 145–240 g/l of solid sodium hydroxide (18°–26° Baumé).

It is the object of the present invention to provide a process for the simultaneous caustic treatment and dyeing of cotton goods that does not have the shortcomings referred to above.

Specifically, the process of this invention for the simultaneous caustic treatment and dyeing of cotton goods with vat dyes comprises (a) in a first phase, padding the textile goods with a dye liquor and subsequently drying them, (b) in a second phase, impregnating the dried goods with a solution of alkali hydroxide, pinching-off the impregnated material and subsequently drying it; and (c) in a third phase, either padding the treated goods with an aqueous mixture of the requisite reducing agents and then effecting a steam treatment or carrying out development on a jigger, after which the treated goods, in the case of steam development as well as jigger development, are subsequently rinsed, oxidised, soaped, rinsed once more and dried.

By means of the process of this invention it is possible to mercerise all textile planar materials which can be subjected to known mercerisation, chiefly pure cotton woven and knitted goods.

Suitable alkali hydroxides are lithium, potassium or sodium hydroxide. The use of sodium hydroxide is especially preferred.

Depending on the desired effect, such as depth of shade, enhancement of handle or lustre or covering dead cotton, the amount of alkali hydroxide employed is 20–250 g/l, preferably of 60–200 g/l, of solid sodium hydroxide.

Dyes eligible for use in the process of this invention are the vat dyes conventionally used for dyeing or printing cellulosic textile materials.

The vat dyes may be higher fused and heterocyclic benzoquinones or naphthoquinones, sulfur dyes and, preferably, anthraquinoid or indigoid dyes. Examples of eligible vat dyes are listed in the Colour Index, 3rd Edition (1971), Vol. 3, on pages 3649–3837 under the headings "Sulphur Dyes" and "Vat Dyes". The eligible vat dyes are substantially stable to the treatment of step (b) and suffer no loss in colour strength nor any change of shade.

The amount of dye will normally depend on the desired depth of shade and is conveniently from 1 to 100 g per kg of goods, preferably 5 to 60 g/kg of goods.

The reducing agent employed for converting the vat dyes into the fibre-reactive form of the leuco compound (vatting) is e.g. sodium dithionite (sodium hydrosulfite). Vatting is effected in alkaline medium. Examples of suitable alkalies are sodium carbonate, sodium bicarbonate, sodium hydroxide, disodium phosphate, trisodium phosphate, borax, aqueous ammonia or alkali donors such as sodium trichloroacetate.

The process of this invention is carried out as follows: The cotton is padded on the pad with a dye liquor which contains a pigment vat dye, a wetting agent and, optionally, a migration inhibitor, expressed to a pick-up of 55–75%, and dried in the temperature range from 100°–130° C.

After it has been dried, the cotton material is padded at room temperature with an aqueous solution that contains 20–250 g/l of solid sodium hydroxide and, optionally, an alkali-resistant wetting agent, and expressed to a pick-up of 60–100%, in the course of which only minimum loss of the pigment dye absorbed by the material occurs.

The treated material is thereafter cautiously dried in the temperature range from 100°–130° C. If desired, the causticised goods can be stored at room temperature for a few hours before being dried.

The goods leave the drying aggregate in a stiff condition and with a yellowish tinge caused by the sodium hydroxide. The dried goods are storage stable.

The dried goods are then either padded on the pad with an aqueous liquor which contains sodium hydroxide, a reducing agent, e.g. sodium dithionite or the sodium salt of hydroxymethanesulfinic acid, a levelling agent and other optional dyeing auxiliaries, and subsequently steamed for 30 to 60 seconds or developed on a jigger for 30 to 45 minutes in the temperature range from 50°–60° C. with the addition of the ingredients referred to above. In both variants of the development, the material is subsequently rinsed, oxidised, soaped, rinsed once more and dried.

The drying aggregate employed for the "caustic dry treatment intermediate step" can also be used for other purposes, so that it is possible to dispense entirely with an actual mercerising unit.

As the "caustic dry treatment intermediate step" is carried out after impregnation with the pigment dye, less side-to-centre shading is to be expected than when dyeing mercerised goods. Thus, for example, when mercerising extra-wide bed linen in chainless mercerising machines, there occurs in and around the edges a fabric compacting which, in the dye application phase (padding/drying), causes irreversible tailing.

The process of this invention can be carried out on desized and boiled cotton fabrics, in which case the dye yield is substantially increased compared with untreated goods. Immature cotton, which otherwise spoils the overall appearance of the goods, is covered. Lustre and handle of the goods are favourably influenced.

The process of this invention is especially suitable for starch-sized raw cotton piece goods. Pleasing denim-like, pale dark effects are obtained on this material by the above described process. A "tramp look" can be imparted to the fabric by means of a subsequent process step such as stone washing. Additional advantages of the process of the invention that may be mentioned are:

the denim effect is obtained direct on raw cotton fabric;

some of the seed husks present on the grey goods are removed, so that they no longer spoil the overall appearance of the fabric;

only insignificant oxidative damage to the cellulose is caused, as the grey goods are protected by the starch size present thereon;

a good degree of whiteness on the goods without special pretreatment;

no expensive process steps such as desizing, boiling and mercerising.

The invention is illustrated by the following Examples in which parts and percentages are by weight, unless otherwise indicated.

EXAMPLE 1

A piece of 100% cotton cretonne, bleached but not mercerised, is padded with a dye liquor which contains 40 g/kg of a commercial formulation of the dye of formula

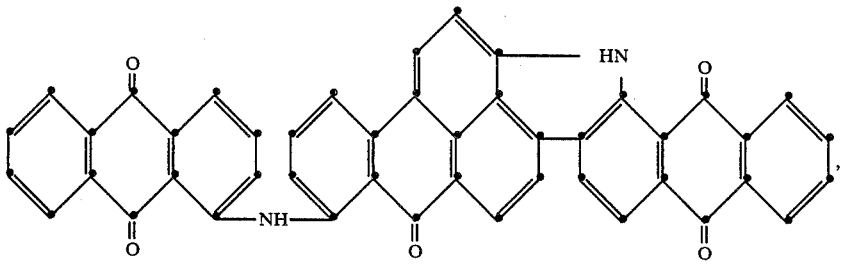

and 10 g/l of a polymer of the potassium salt of 2-acrylamido-2-methylpropanesulfonic acid. The impregnated fabric is expressed to a pick-up of 65% by two passages on a Benz laboratory padder and dried for 1 minute in a Benz laboratory drying apparatus. The dried fabric is then padded at room temperature (18°-25° C.) with an aqueous liquor containing 200 g/l of sodium hydroxide (100%), expressed to a pick-up of 75%, and dried under controlled tension at 130° C. The dried piece of fabric is then padded at room temperature (18°-25° C.) with a liquor containing 50 ml/l of sodium hydroxide (36° Baumé) and 50 g/l of sodium dithionite, expressed to a pick-up of 75%, and steamed for 1 minute at 100° C. with saturated steam. The fabric is subsequently rinsed, oxidised, soaped, rinsed once more and dried, to give a level, brilliant olive dyeing of high tinctorial strength.

EXAMPLE 2

A piece of 100% starch-sized cotton fabric with a high husk content (weight: 325 g/m$^2$) is padded at room temperature with a dye liquor that contains 50 g/l of a commercial formulation of the dye of formula

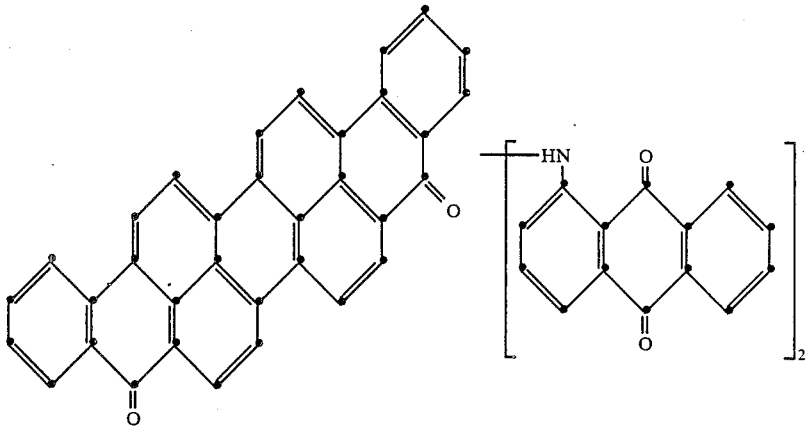

5 g/l of a polymer of the potassium salt of 2-acrylamido-2-methylpropanesulfonic acid and 5 g/l of an alkali-resistant wetting agent, expressed to a pick-up of 45% by two passages on a Benz laboratory padder, and dried for 1 minute at 120° C. in a Benz laboratory drying apparatus.

The dried fabric is then padded at room temperature (18°-25° C.) with an aqueous liquor containing 200 g/l of sodium hydroxide (100%), expressed to a pick-up of 65%, and dried at 100° C. under controlled tension.

The dried fabric is then padded at room temperature (18°-25° C.) with a liquor that contains 50 ml/l of sodium hydroxide (36° Bé) and 50 g/l of sodium dithionite, expressed to a pick-up of 60%, and dried for 1 minute at 100° C. with saturated steam.

The treated fabric is subsequently rinsed, dried, rinsed once more and dried, to give a dyeing with level, denim-like black-white effects.

EXAMPLE 3

A piece of 100% cotton cretonne fabric, desized and boiled, having a weight of 140 g/m$^2$, is padded at room temperature (18°–25° C.) with a dye liquor that contains 50 g/l of a commercial formulation of the dye of formula

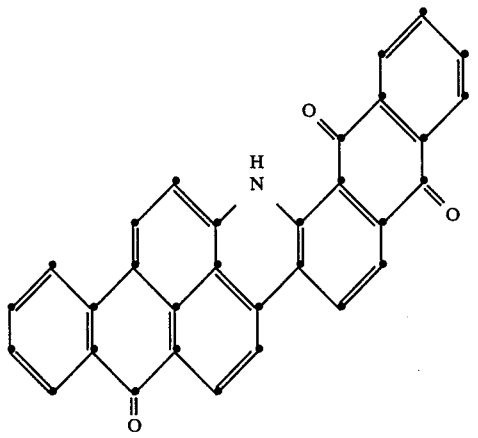

5 g/l of a polymer of the potassium salt of 2-acrylamido-2-methylpropanesulfonic acid and 5 g/l of an alkali-resistant wetting agent, expressed to a pick-up to 70% by one passage on a Mathis laboratory padder, and then dried for 1 minute at 120° C. in a Benz laboratory drying apparatus and batched up.

The treated and dried fabric is then padded on a Mathis laboratory padder at room temperature with an aqueous liquor that contains 200 g/l of sodium hydroxide (100%), expressed to a pick-up of c. 70%, and dried at 100° C. in a Benz laboratory drying apparatus and batched up.

The fabric is subsequently developed on a Benz laboratory jigger with 10 ml/l of sodium hydroxide (36° Bé) and 8 g/l of hydrosulfite for 30 minutes at 60° C., then rinsed cold with overflow, treated cold with 10 g/l of sodium bicarbonate, oxidised with 2 ml/l of 35% hydrogen peroxide and 2 ml/l of 80% acetic acid, soaped at the boil, and rinsed cold.

A strong level dyeing is obtained.

What is claimed is:

1. A process for the simultaneous caustic treatment and dyeing of cotton goods with vat dyes by the pad-steam process, which comprises (a) in a first phase, padding the textile goods with a dye liquor and subsequently drying them, (b) in a second phase, impregnating the dried goods with a solution of alkali hydroxide, pinching-off the impregnated material and subsequently drying it; and (c) in a third phase, either padding the treated goods with an aqueous mixture of the requisite reducing agents and then effecting a steam treatment or carrying out development on a jigger, after which the treated goods, in the case of steam development as well as jigger development, are subsequently rinsed, oxidised, soaped, rinsed once more and dried.

2. A process according to claim 1, which comprises using an aqueous solution containing 20–250 g/l of solid sodium hydroxide in phase (b).

3. A process according to claim 2, wherein the treated goods are dried after phase (b) in the temperature range from 100° to 130° C.

4. A process according to claim 1, wherein the treated goods are steamed for 30 to 60 seconds in phase (c).

5. A process according to claim 1, wherein the treated goods are developed in phase (c) for 30 to 40 minutes in the temperature range from 55° to 60° C.

6. Cotton material treated by a process as claimed in claim 1.

* * * * *